US012158154B2

(12) United States Patent
Wen et al.

(10) Patent No.: US 12,158,154 B2
(45) Date of Patent: Dec. 3, 2024

(54) OPTIMIZATION SYSTEMS AND METHODS FOR OPERATING AIR COMPRESSOR GROUPS

(71) Applicant: WISTRON CORPORATION, New Taipei (TW)

(72) Inventors: Bang-Chun Wen, New Taipei (TW); Ji Wang, New Taipei (TW)

(73) Assignee: WISTRON CORPORATION, New Taipei (TW)

( * ) Notice: Subject to any disclaimer, the term of this patent is extended or adjusted under 35 U.S.C. 154(b) by 294 days.

(21) Appl. No.: 17/875,475

(22) Filed: Jul. 28, 2022

(65) Prior Publication Data

US 2023/0340962 A1 Oct. 26, 2023

(30) Foreign Application Priority Data

Apr. 25, 2022 (CN) ..... 202210438391.X

(51) Int. Cl.
*F04D 25/16* (2006.01)
*F04C 28/02* (2006.01)
*F04D 27/00* (2006.01)

(52) U.S. Cl.
CPC ..... *F04D 25/16* (2013.01); *F04C 28/02* (2013.01); *F04D 27/00* (2013.01)

(58) Field of Classification Search
CPC ..... F04D 25/16; F04D 27/00; F04C 28/02; F04B 41/06; F04B 49/065
See application file for complete search history.

(56) References Cited

U.S. PATENT DOCUMENTS

2002/0188422 A1* 12/2002 DeRose ..... F04D 27/02 702/182
2004/0175273 A1* 9/2004 Dean ..... F04B 49/03 417/44.2
2010/0082293 A1* 4/2010 Mitchell ..... G05B 19/0428 702/182

(Continued)

FOREIGN PATENT DOCUMENTS

CN 202091164 U 12/2011
CN 102486171 A 6/2012

(Continued)

*Primary Examiner* — Charles G Freay
*Assistant Examiner* — Benjamin Doyle
(74) *Attorney, Agent, or Firm* — Peigen Jiang; Greenberg Traurig, LLP

(57) ABSTRACT

A control system for operating a plurality of air compressors collectively supplying compressed air to a manufacturing facility is disclosed which includes a demand forecast module configured to estimate the manufacturing facility's demand for the compressed air at a predetermined future time, a dynamic adjustment module configured to acquire a current air pressure from the manufacturing facility, the dynamic adjustment module combining the current air pressure and the estimated manufacturing facility's demand for compressed air to make a final forecast, and an optimization module configured to determine a target operating combination of the plurality of air compressors at the predetermined future time based on the final forecast and a current operating combination of the plurality of air compressors.

20 Claims, 7 Drawing Sheets

(56) References Cited

U.S. PATENT DOCUMENTS

| | | | | |
|---|---|---|---|---|
| 2012/0029706 | A1* | 2/2012 | Wagner | F04B 49/06 700/282 |
| 2020/0342150 | A1* | 10/2020 | Zhao | G06Q 50/04 |
| 2021/0048016 | A1* | 2/2021 | Bromfield | F04B 49/065 |
| 2023/0313950 | A1* | 10/2023 | Van Roy | G05B 13/048 700/282 |

FOREIGN PATENT DOCUMENTS

| | | | |
|---|---|---|---|
| CN | 114154692 | A | 3/2022 |
| WO | 2017054596 | A1 | 4/2017 |

* cited by examiner

OPTIMIZATION SYSTEMS AND METHODS FOR OPERATING AIR COMPRESSOR GROUPS

BACKGROUND

The present disclosure relates generally to air compressor operations, and, more particularly, to optimization systems and methods for operating air compressor groups.

Compressed air is widely used in manufacturing facilities for a variety of applications, such as blowing water or dirt off manufactured parts and driving pneumatic tools or robotic arms. An air compressor increases the pressure of inlet air by reducing its volume. The majority of air compressors have, at their core, either centrifugal impellers or rotary screws that compress the air.

By the very physics and thermodynamics involved, compressing air is naturally inefficient. Most of the electrical power consumed by the motor that drives the air compressor heats the air. The air that exits the compressor must then be cooled, which requires a fan and an air- or water-cooled heat exchanger, which consumes even more energy.

Once the air is compressed, it has to be delivered at a certain pressure to the end users. As the air is transported, losses occur and inefficiencies arise along the way. By the time air is compressed, cooled, dried, transported, regulated, and then finally used, electric costs for air compressors can account for up to 30% of a manufacturing site's total electric bill.

In a large manufacturing site, compressed air is normally supplied by a central station having multiple air compressors operating in a group. As demand for compressed air can fluctuate throughout the day due to workload changes at various sections of the manufacturing site, these air compressors may have to adjust operation pattern in response. In high demand time, more air compressors have to run; and in low demand time, some air compressors have to stop. Frequently turning on and off an air compressor is very inefficient, as a newly started air compressor needs a long time to build up air pressure before it can deliver compressed air to production lines. As such, optimizing the operations of the air compressor group is desired.

SUMMARY

A control system for operating a plurality of air compressors collectively supplying compressed air to a manufacturing facility is disclosed which includes a demand forecast module configured to estimate the manufacturing facility's demand for the compressed air at a predetermined future time, a dynamic adjustment module configured to acquire a current air pressure from the manufacturing facility, the dynamic adjustment module combining the current air pressure and the estimated manufacturing facility's demand for compressed air to make a final forecast, and an optimization module configured to determine a target operating combination of the plurality of air compressors at the predetermined future time based on the final forecast and a current operating combination of the plurality of air compressors.

A method for operating a plurality of air compressors collectively supplying compressed air to a manufacturing facility includes estimating the manufacturing facility's demand for the compressed air at a predetermined future time by acquiring future operational demand information from the manufacturing facility, historic data of the compressed air supplied by the plurality of air compressors and an average consumption rate of the compressed air by the manufacturing facility, dynamically forecasting the manufacturing facility's demand for the compressed air by converting a difference between a current air pressure and a predetermined threshold to a required additional volume of compressed air and combining the required additional volume and the estimated manufacturing facility's demand for the compressed air to generate a final forecast, and determining a target operating combination of the plurality of air compressors at the predetermined future time based on the final forecast and a current operating combination of the plurality of air compressors.

Figure 1:
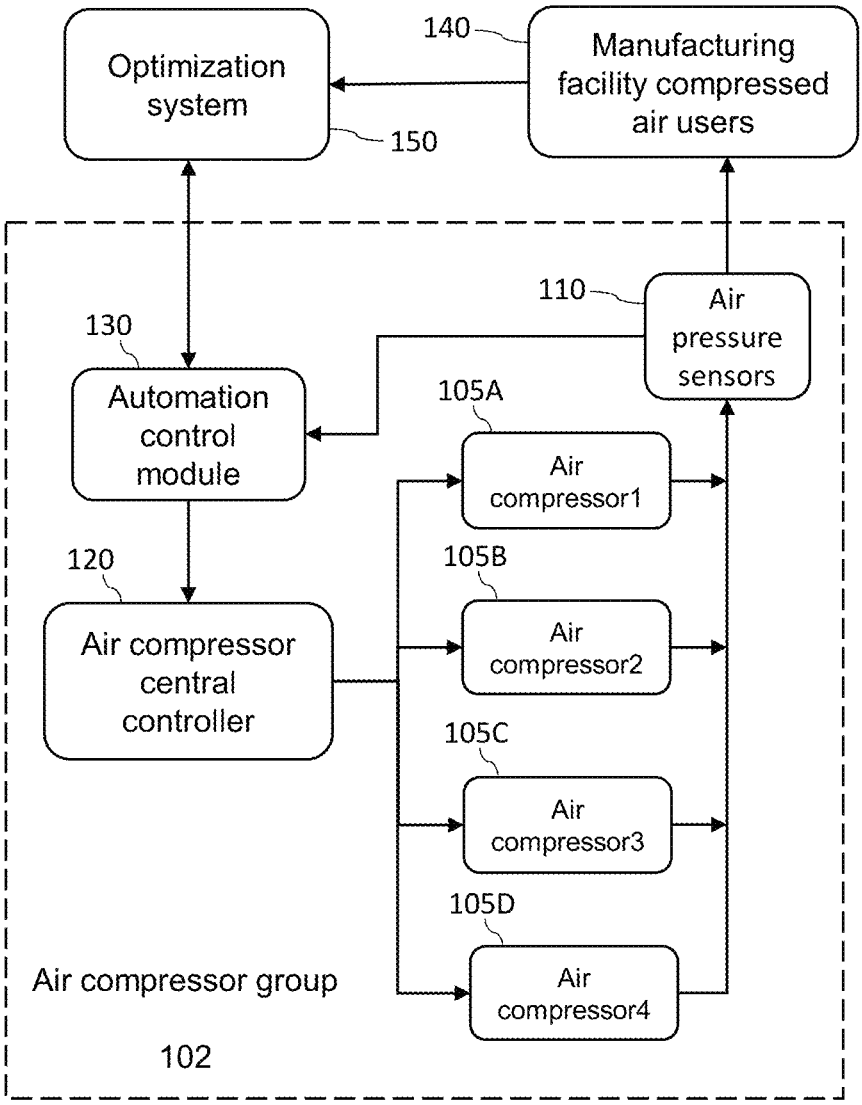
FIG. 1 illustrates an air compressor group operating to supply compressed air to a production facility in accordance with embodiments of the present disclosure.

The drawings accompanying and forming part of this specification are included to depict certain aspects of the disclosure. A clearer conception of the disclosure, and of the components and operation of systems provided with the disclosure, will become more readily apparent by referring to the exemplary, and therefore non-limiting, embodiments illustrated in the drawings, wherein like reference numbers (if they occur in more than one view) designate the same elements. The disclosure may be better understood by reference to one or more of these drawings in combination with the description presented herein.

DESCRIPTION

The present disclosure relates to optimizing operations of an air compressor group in a large manufacturing facility. Preferred embodiments of the present disclosure will be described hereinafter with reference to the attached drawings.

FIG. 1 illustrates an air compressor group 102 operating to supply compressed air to a production facility 140 in accordance with embodiments of the present disclosure. The air compressor group 102 exemplarily includes four air compressors 105A-105D, which are controlled by an air compressor central controller 120. In embodiments, one or more of the air compressors 105A-105D may be variable frequency air compressors. The air compressor central controller 120 can turn on or off any of the air compressors 105A-105D independently as well as change frequencies of the variable frequency air compressors among 105A-105D, so that the supply of compressed air can be adjusted in response to a demand for compressed air in a manufacturing facility 140. The air compressor central controller is controlled by an automation control module 130 which determines operating status of the air compressor group 102, i.e., which air compressor(s) 105A-105D should be turned on or operate at a certain frequency at a particular time. The automation control module 130 acquires air pressures in real time at an air supply line to the manufacturing facility 140 as well as at each air compressors 105A-105D from air pressure sensors 110, and provide the air pressure data along with the operating status of the air compressor group 102 to an optimization system 150 (also called a control system). The optimization system 150 also collects environmental data and manufacturing facility 140's compressed air demand data. The environmental data include temperature, humidity, and atmospheric particulate matter (PM2.5) at the manufacturing facility. The compressed air demand data include a number of operating production lines, a number of workers at the operating production lines, and designed production volume. Armed with the aforementioned data, the optimization system 150 determines an optimized operating conditions for the air compressor group 102.

Figure 2:
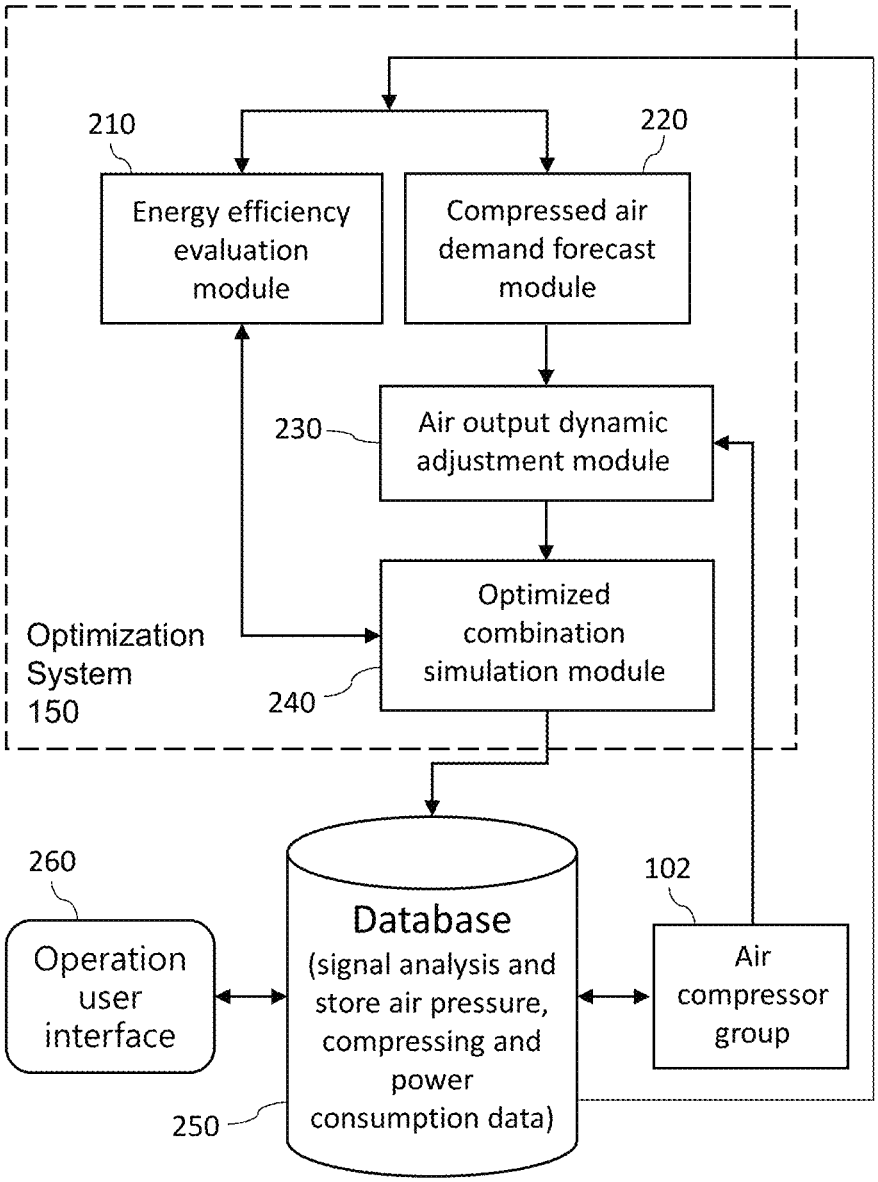
FIG. 2 illustrates various modules in the optimization system in accordance with embodiments of the present disclosure.

FIG. 2 illustrates various modules in the optimization system 150 in accordance with embodiments of the present disclosure. The optimization system 150 includes an energy efficiency evaluation module 210, a compressed air demand forecast module 220, an air output dynamic adjustment module 230, and an optimized combination simulation module 240 (also called an optimization module). In addition, the optimization system 150 employs a database 250 to perform signal analysis and store air pressure, production line planning information (e.g., a number of production lines expected to operate in the future or during a future time period) and power consumption data. The signals stored in the database controls the operations of the air compressor group 102. The production line planning information are supplied to the compressed air demand forecast module 220 to make a forecast for a demand for compressed air by the production lines in a predetermined future time. In other words, the demand forecast module 220 generates a forecast result which is related to a future demand for compressed air by the production lines. The database 250 is also coupled to an operation user interface 260 for system operators to enter factory air demand forecast data and display operation status and historic data of the air compressor group 102. Each of these modules will be described in detail hereinafter.

Figure 3:
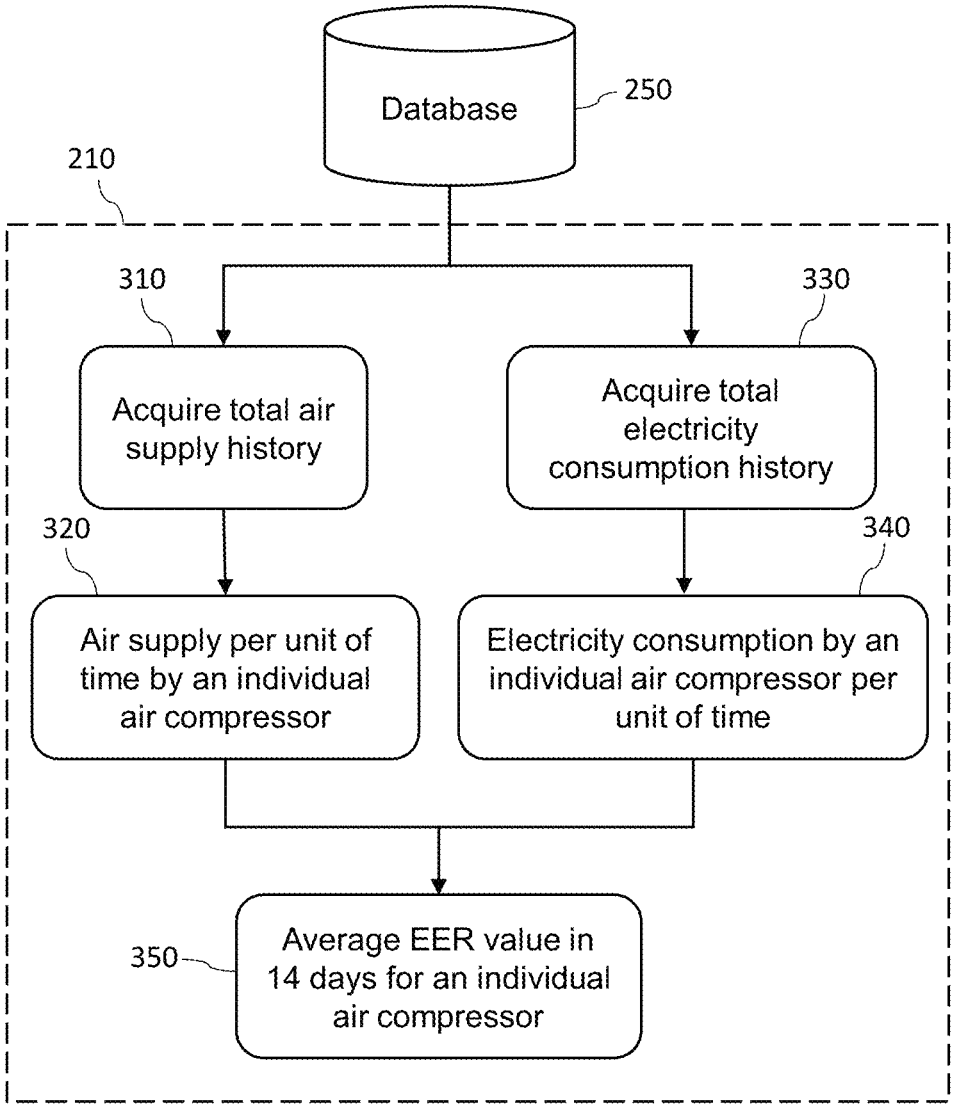
FIG. 3 illustrates a flowchart for the energy efficiency evaluation module.

FIG. 3 illustrates a flowchart for the energy efficiency evaluation module 210 which serves to evaluate energy efficiency ratio (EER) of the air compressor group 102. Specifically, the energy efficiency evaluation module 210 is used to evaluate the energy efficiency ratio of each air compressor in a predetermined time interval. In an embodiment, the EER value is displayed and stored for system monitoring.

As shown in FIG. 3, the energy efficiency evaluation module 210 in the one hand acquires total air supply history from a database 250 in block 310; and then calculate an air supply per unit of time (a discharge volume of compressed air per unit time by a single air compressor) by an individual air compressor in block 320. On the other hand, the energy efficiency evaluation module 210 acquires total electricity consumption history from the database 250 in block 330; and then calculates electricity consumption by the individual air compressor per unit of time (an amount of power consumed by a single air compressor in a predetermined time period) in block 340. Subsequently, the energy efficiency evaluation module 210 calculates an average EER value in the past 14 day (a predetermined time period) for the individual air compressor in block 350 using the air supply data from the block 320 and the electricity consumption data (the amount of power consumed) from the block 340 (Air supply divided by the electricity consumed). In such a way, the EER of a particular air compressor can be determined. The higher the EER value the better the energy efficiency achieved by the individual air compressor.

Although data from past 14 day is exemplary used in EER calculation, in embodiments, other durations such as 10 days or 20 days may be used instead. In order to obtain most updated EER data for a particular air compressor, the database 250 that supplies the air supply data and the electricity consumption data is exemplarily updated every 5 minutes. Referring back to FIG. 2, in an embodiment, the EER data is fed into the optimized combination simulation module 240 for determining a target operational combination of the air compressor group 102 in a predetermined future time.

Figure 4:
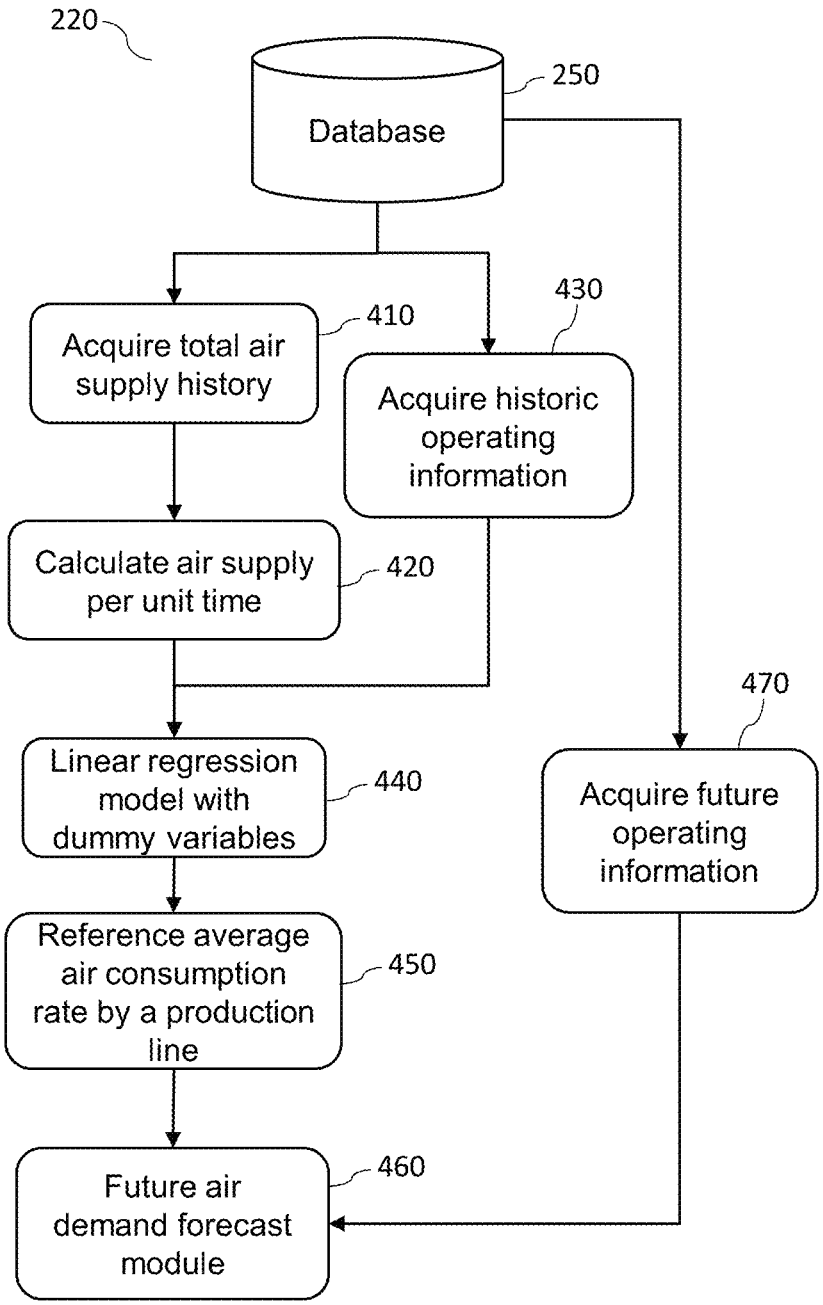
FIG. 4 illustrates a flowchart for the compressed air demand forecast module.

FIG. 4 illustrates a flowchart for the compressed air demand forecast module 220. In block 410, the compressed air demand forecast module 220 acquires total air supply history data from the database 250. In block 420, air supply per unit time is calculated from the total air supply history data (i.e., discharged air volume). At the same time, historic operating information, such as a number of operating production lines (i.e., the number of production lines operating in the past time, that is, the number of production lines operating in the aforementioned predetermined time period), are acquired from the database 250 in block 430. In an embodiment, historical data of the air compressor group 102 stored in the database 250 includes total air supply historical data and historical operation information. In some embodiments, the historical operation information is the operation information of each air compressor during a period of time when the historical data (specifically, the master feeder historical data) appears. In embodiments, both the air supply history data and the historic operating information are preprocessed to eliminate abnormal data points caused by abnormal data collections. The air supply history data and the historic operating information are then supplied as variables to a linear regression model in block 440. In an embodiment, the linear regression model is initially supplied with dummy variables.

In an embodiment, the linear regression model in block 440 is expressed as $$Y=X\beta+\varepsilon \quad \text{(Equation 1)}$$

where Y is compressed air demand (i.e., compressed air demand forecast results), X represents a factor of a number of operating production lines and two timing factors (a day of the week and time of a day), and ε is a random error term. Then use matrix differential on Equation 1 to achieve minimum value for $$(Y-X\hat{\beta})'(Y-X\hat{\beta}) \quad \text{(Equation 2)}$$

$$\text{when } \hat{\beta}=(X^TX)^{-1}X^TY \quad \text{(Equation 3)}$$

Referring to FIG. 4 again, a reference average air consumption rate by a production line (i.e., the average consumption rate of compressed air by the manufacturing equipment 140) is obtain in block 450, and supplied to a compressed air demand forecast module 220 in block 460. Here the average air consumption rate is used because air consumption in a production line is inevitably swell and ebb over time as machines operating on compressed air may be on and off from time to time. Therefore, the average air consumption rate is calculated from dividing a sum of air consumption during a predetermined time by a duration of the time. The Future operating information, such as a number of operating production lines at a particular time (specifically, this is the number of production lines expected to operate in the predetermined future time, i.e., the abovementioned production line planning information) is acquired from the database 250 and supplied to the compressed air demand forecast module 220 in block 470. The compressed air demand forecast module 220 calculates future air demand (Y—future demand information) based on following equation.

$$Y=\beta_0+\beta_1*L_1+\beta_2*L_2+\ldots+\beta_5*L_5+\beta_{1\#}*(\text{Monday})+\beta_{2\#}*(\text{Tuesday})+\ldots\beta_{5\#}*(\text{Friday})+\beta_{1\$}*(01{:}00)+\beta_{2\$}*(02{:}00)+\ldots+\beta_{23\$}*(23{:}00) \quad \text{(Equation 4)},$$

where $\beta_0$ is overall baseline, and then $\beta_k$ is compressed air consumption rate at a Kth production line $L_k$, $\beta_{m\#}$ is compressed air consumption rate at mth day, and $\beta_{n\$}$ is compressed air consumption rate at nth hour.

Since the time frequency factor has 24 time periods, the effective value calculation will only be performed on a single regression coefficient estimated value in the same time period, then the number of operating production lines in production planning information and actual operating time is considered. For instance, in order to estimate demand for compressed air in production lines 1-3 of the production facility 140 on Monday 9:30 am (i.e., a predetermined future time), since the time frequency factors are all set as virtual variable factors, only the Monday's regression coefficient and time period 9:30-10:30 am's regression coefficient is used in calculating compressed air demand forecast. In this case, the variable for a certain time period is set at "1" and other not-relevant time period is set at "0". Afterwards, the actual numbers of operating production lines are taking into account and added up to arrive at a total compressed air demand forecast based on Equation (2). When the numbers of operating production lines changes, the new numbers will be used in Equation (2) in calculating forecast for compressed air demand. Embodiments of the present disclosure makes the forecast for compressed air demand more accurate so that power consumption can be optimized.

Figure 5:
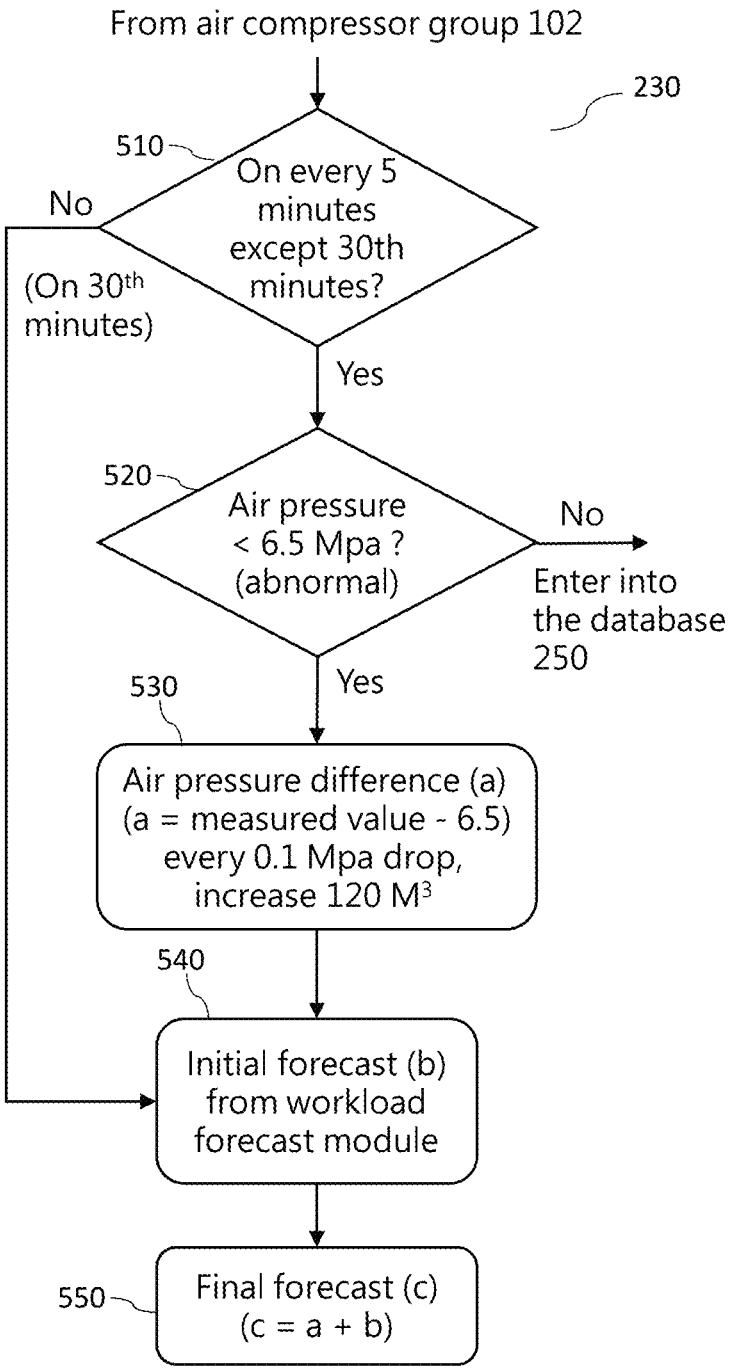
FIG. 5 illustrates a flowchart for the air output dynamic adjustment module.

FIG. 5 illustrates a flowchart for the air output dynamic adjustment module 230 which considers both the static forecast (i.e., compressed air demand forecast results) from the compressed air demand forecast module 220 and dynamic fluctuations of air pressures in the production lines to make a final compressed air demand forecast (referred to as "final forecast" hereinafter). In block 510, a timer together with the air pressure sensors 110 track air pressures of the air compressor group 102 (referred to as the "current air pressure value" hereinafter, and can also be referred to as the first parameter of the current operation) every 5 minutes except on the $30^{th}$ minutes. Although 5 minutes interval is used here, in other embodiments, different time intervals may be used instead. In block 520, if the current air pressure value is higher than a predetermined threshold, the air pressure data (i.e., the current air pressure value) is entered into the database 250 to be stored as a historic record. If the current air pressure value is lower than the predetermined threshold, i.e., the current air pressure value is abnormal, the output dynamic adjustment module 230 calculates an air pressure difference (a) between the current air pressure value and the predetermined threshold in block 530. In an embodiment, the predetermined threshold is set at 6.5 Mpa. In embodiments, for every 0.1 Mpa drop, the discharge volume of compressed air needs to increase by 120 $M^3$. In this case, the difference in air pressure is converted into an additional demand for discharge volume of the compressed air. For example, the additional demand for discharge volume of the compressed air can be obtained by multiplying the air pressure different by 120. In block 540, the output dynamic adjustment module 230 obtains an initial forecast (b) (i.e., the compressed air demand forecast results) from the compressed air demand forecast module 220. In block 510, if the time tracker is on a $30^{th}$ minutes, the operation jumps to block 540 directly. In block 550, a final air demand forecast (c) (i.e., the final forecast) is obtained by adding the air pressure difference (a) to the initial forecast (b), i.e., c=a+b. The final forecast (c) is used for future operation of the air compressor group 102.

Figure 6:
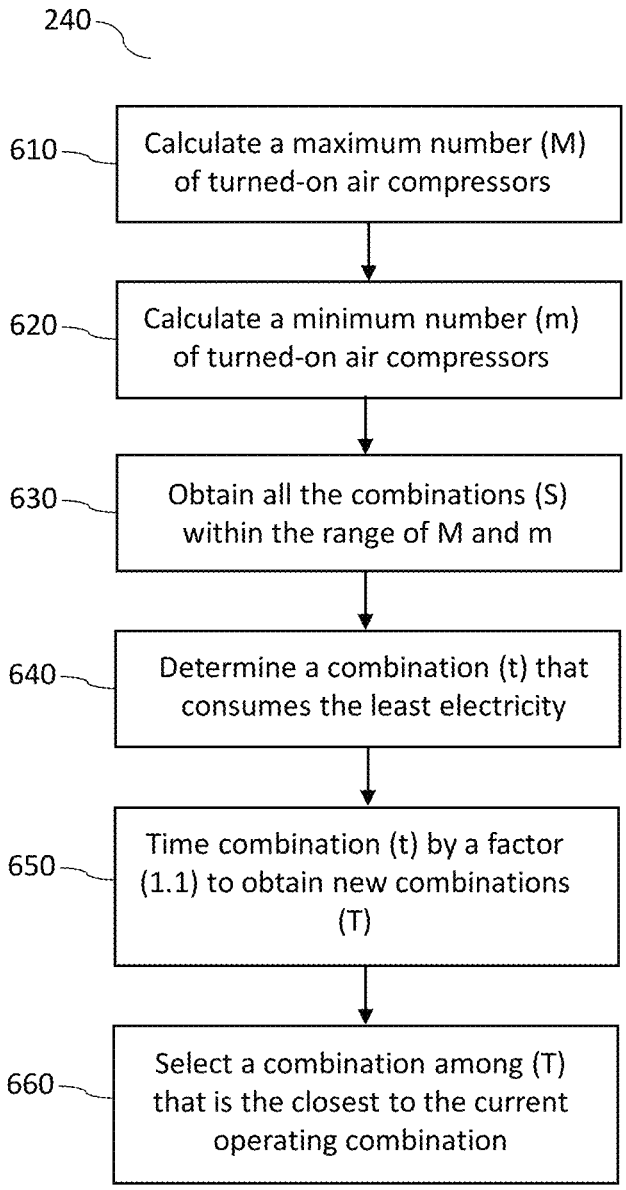
FIG. 6 illustrates a flowchart for the optimized combination simulation module.

FIG. 6 illustrates a flowchart for the optimized combination simulation module 240. In a manufacturing facility 140, the power consumption of an air compressor group and the discharge volume of its produced compressed air can be expressed in a following power consumption and target air production equation.

$$\min E=P*Q+\Sigma PQ+\Sigma P'(PLR)s.t\Sigma DVO+\Sigma DV'(PLR)\geq D \quad \text{(Equation 5)}$$

where, E represents total power consumption; Pi represents the power consumption by an ith air compressor (P' represents variable frequency air compressor); DVi represents volume of air production by an ith air compressor.

Equation 5 has three restrictions. A first restriction is that the air production from a target combination must be higher than or equal to a forecasted air production. A second restriction is that there must be at least one variable frequency air compressor in a target combination. The target combination refers to designating certain air compressor to operate to supply air to the manufacturing facility at a particular time. A third restriction is that a current target combination must not differ from a previous target combination by more than a predetermined number of operating air compressors. In an embodiment, target combinations are calculated every half hour. The predetermined number is relative to a total number of air compressors serving the manufacturing facility. In an embodiment, the predetermined number is set at two. The third restriction intends to minimize frequent turn-on and turn-off of the air compressors as a freshly turned-on air compressor need time to build up air pressure before it can supply compressed air to a production line. In one embodiment, however, there is no restriction that at least one inverter air compressor is required, that is, the second restriction can be omitted.

Referring to FIG. 6 again, the optimized combination simulation module 230 obtains next half hour demand forecast data (i.e., a final air demand forecast result) from the air output dynamic adjustment module 230 and calculates a maximum number (M) of turned-on air compressors for a target combination that satisfies the final air demand forecast result based on Equation 5 in block 610. The optimized combination simulation module 240 also calculates a minimum number (m) of turned-on air compressors for the target combination that satisfies the final air demand forecast result also based on Equation 5 in block 620. In block 630, the optimized combination simulation module 240 obtains a group of all the combinations (S) (i.e., a first group) of operating air compressors for the next half hour within the range of M and m. In block 640, the optimized combination simulation module 240 uses either the database 250 or the energy efficiency evaluation module 210 to calculate respective EERs of the first group of all the combinations (S) and determines a subset of combinations (t) among the group of all the combinations (S) that consumes the least electricity (i.e., minimum power consumption). In block 650, the combination (t) is timed by a predetermined factor larger than one to obtain new group of combinations (T) (i.e., a second group). For example, the optimized combination simulation module 240 selects a new group of combinations (T) with each combination within the group T consuming less power than the subset of combinations (t) does including the latter power consumption is multiplied by the predetermined factor. In an embodiment, the predetermined factor is set at 1.1. In block 660, the optimized combination simulation module 240 select a combination form the first group (T) that is closest to the current operating combination as a target operating combination.

The flowchart shown in FIG. 6 can be illustrated by an example of a manufacturing facility that has four air compressors in a compressed air production group. The four air compressors provide $2^4-1$ number of combinations. Air compressor A has a capacity of producing 500 $m^3$/hour compressed air; air compressor B has a capacity of producing 700 $m^3$/hour compressed air; variable frequency air compressor C has a capacity of producing 500-1100 $m^3$/hour compressed air; and air compressor D has a capacity of producing 100 $m^3$/hour compressed air. Among them the variable frequency air compressor C can be viewed as a collection of multiple fixed frequency air compressors (with compressed air production capacities of 500, 600, 700, 800, 900, 1000, 1100 $m^3$/hour). In this case, a maximum number of turned-on air compressors M=4, i.e., compressors A, B, C at 500 $m^3$/hour and D are turned on. On the other hand, a minimum number of turned-on air compressors m=2, i.e., compressors B and C at 500 $m^3$/hour are turned on. Then the optimized combination simulation module 240 uses permutation and combination method to filter out combinations in the group of all the combinations (S) between M and m that can produce required discharge volume of compressed air. As an example, group S is expressed as {[A, B, C(500), D], [A, B, C(600), D], . . . [A, B, C(1100), D], [A, C(1100)]}, i.e., S={[A, B, C(500), D], [A, B, C(600), D], . . . [A, B, C(1100), D], [A, C(1100)]}. Power consumption of each combination within the group (S) is then calculated. For instance, turning on a combination [A, B, C(500), D] consumes 9.7 KW-h per hour; and turning on a combination [A, C(1100)] consumes 8.9 KW-h per hour. Then a combination (t) that consumes the least amount of electricity (least power consumption) is t=[A, C(1100)]. A next step is to expand the power consumption value by a factor, such as 1.1, i.e., 8.9 KW-h per hour times 1.1 to arrive at a 9.79 KW-h per hour threshold value. With this threshold value, additional combinations, such as [A, B, C(500)], [A, B, C(600)], [A, B, C(700)] and [A, B, C(800)], may be selected along with combination (t) to form a new group of combinations (T). Finally, a combination that is closest to the current operating combination among the new group of combinations (T) is selected as an optimized combination for a next time period operating combination (i.e., a target operating combination). In an example, if current operating combination has compressor C turned on, adding compressor A has the least power consumption and least change in compressor operation status, thus a combination A and C is selected as an optimized combination (i.e., a target operating combination). In an embodiment, the number of changed compressors (turning on or off) is limited to one or 2 units.

Figure 7:
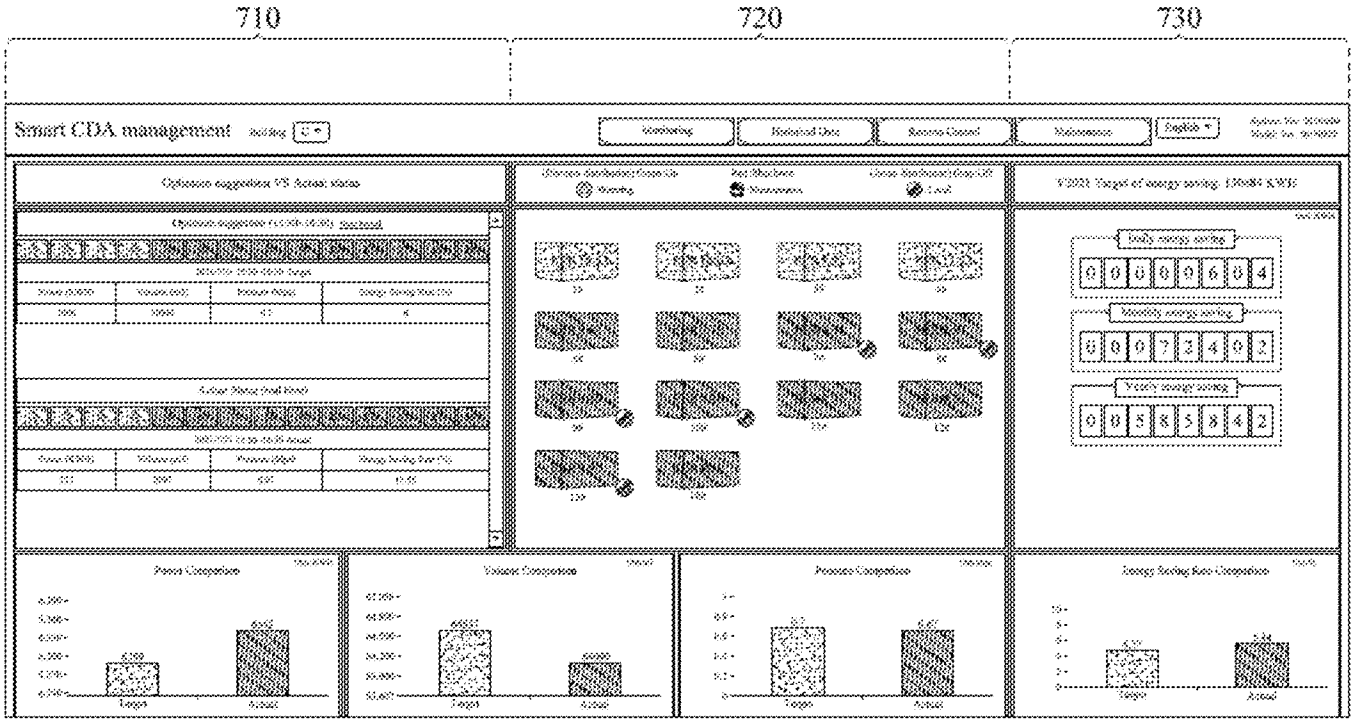
FIG. 7 illustrates an exemplary user interface screenshot in accordance with embodiments of the present disclosure.

FIG. 7 illustrates an exemplary user interface screenshot in accordance with embodiments of the present disclosure. There are three sections in the user interface display. A first section 710 displays optimum suggestion vs actual operation status and respective power consumptions. A second section 720 displays current operation status of each air compressors. A third section 730 displays daily, monthly and yearly energy savings by the optimization system 150 according to embodiments of the present disclosure. If the first section 710 displays a difference between the optimum suggestion and the actual operation status, an operator may check the second section 720 to see if any air compressor is operating abnormally, or the demand for compressed air has changed.

Although air compressor group operation with compressed air as a consumable material is described as embodiments of the present disclosure, the disclosed optimization systems and methods can be applied to other systems, such as central air conditioning system, in which multiple machines collectively supply cooled air as a consumable material to a recipient system. Both the compressed air and the cooled air dissipate to the environment as the users use them. However, another example of such consumable material can be water used in a water heater system.

Some portions of the preceding detailed descriptions have been presented in terms of algorithms and symbolic representations of operations on data bits within a computer memory. These algorithmic descriptions and representations are the ways used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities. Usually, though not necessarily, these quantities take the form of electrical or magnetic signals capable of being stored, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. The present disclosure can refer to the action and processes of a computer system, or similar electronic computing device, that manipulates and transforms data represented as physical (electronic) quantities within the computer system's registers and memories into other data similarly represented as physical quantities within the computer system memories or registers or other such information storage systems.

The present disclosure also relates to an apparatus for performing the operations herein. This apparatus can be specially constructed for the intended purposes, or it can include a general purpose computer selectively activated or reconfigured by a computer program stored in the computer. Such a computer program can be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, each coupled to a computer system bus.

The algorithms and displays presented herein are not inherently related to any particular computer or other apparatus. Various general purpose systems can be used with programs in accordance with the teachings herein, or it can prove convenient to construct a more specialized apparatus to perform the method. The structure for a variety of these systems will appear as set forth in the description below. In addition, the present disclosure is not described with reference to any particular programming language. It will be appreciated that a variety of programming languages can be used to implement the teachings of the disclosure as described herein.

The present disclosure can be provided as a computer program product, or software, that can include a machine-readable medium having stored thereon instructions, which can be used to program a computer system (or other electronic devices) to perform a process according to the present disclosure. A machine-readable medium includes any mechanism for storing information in a form readable by a machine (e.g., a computer). In some embodiments, a machine-readable (e.g., computer-readable) medium includes a machine (e.g., a computer) readable storage medium such as a read only memory ("ROM"), random access memory ("RAM"), magnetic disk storage media, optical storage media, flash memory components, etc.

In this description, various functions and operations are described as being performed by or caused by computer instructions to simplify description. However, those skilled in the art will recognize what is meant by such expressions is that the functions result from execution of the computer instructions by one or more controllers or processors, such as a microprocessor. Alternatively, or in combination, the functions and operations can be implemented using special purpose circuitry, with or without software instructions, such as using Application-Specific Integrated Circuit (ASIC) or Field-Programmable Gate Array (FPGA). Embodiments can be implemented using hardwired circuitry without software instructions, or in combination with software instructions. Thus, the techniques are limited neither to any specific combination of hardware circuitry and software, nor to any particular source for the instructions executed by the data processing system.

Although the disclosure is illustrated and described herein as embodied in one or more specific examples, it is nevertheless not intended to be limited to the details shown, since various modifications and structural changes may be made therein without departing from the spirit of the disclosure and within the scope and range of equivalents of the claims. Accordingly, it is appropriate that the appended claims be construed broadly and, in a manner, consistent with the scope of the disclosure, as set forth in the following claims.

What is claimed is:

1. A control system for operating a plurality of machines collectively supplying a consumable material to a recipient system, the control system comprising:

a database configured to store consumption history of the consumable material and future operating information of the recipient system;

a pressure sensor configured to acquire a first parameter of a current operation from the recipient system;

a controller configured to control operations of the plurality of machines and sample a current operating combination of the plurality of machines;

at least one volume sensor configured to measure a volume of the consumable material supplied by each of the plurality of machines during a predetermined time period;

at least one power meter configured to measure an amount of power consumed by each of the plurality of machines during the predetermined time period; and at least one computing device executing software instructions to:

calculate the recipient system's future demand for the consumable material at a predetermined future time based at least in part on the stored consumption history and the future operating information, produce a final forecast based at least in part on combining the first parameter and the future demand, calculate an energy efficiency rate (EER) of each of the plurality of machines by dividing the volume of the consumable material supplied by the machine by the amount of power consumed by the machine, determine a target operating combination of the plurality of machines at the predetermined future time based on the final forecast and the current operating combination of the plurality of machines, and send at least one control signal carrying the target operating combination to the controller for operating the plurality of machines based on the target operating combination, wherein the controller is configured to operate the plurality of machines based on receiving the at least one control signal.

2. The control system of claim 1, wherein the stored consumption history comprises historic data of the consumable material supplied by the plurality of machines and an average consumption rate of the consumable material by the recipient system.

3. The control system of claim 2, wherein the historic data of the consumable material supplied by the plurality of machines comprise operating information of each of the plurality of machines during a time period the historic data occur.

4. The control system of claim 1, wherein the at least one computing device executing software instructions converts a difference between the first parameter and a predetermined threshold to a measure of a demand for the consumable material by the recipient system.

5. The control system of claim 1, wherein the at least one computing device executing software instructions determines a maximum number and a minimum number of the plurality of machines to be turned on to meet the final forecast.

6. The control system of claim 5, wherein the at least one computing device executing software instructions determines a first group of combinations of the plurality of machines to be turned on within the maximum and the minimum number of the plurality of machines.

7. The control system of claim 6, wherein the at least one computing device executing software instructions selects a first combination that consumes the least power among the first group of combinations based on the EER of each of the plurality of machines, then selects a second group of combinations of the plurality of machines with each member of the combination consuming less power than is consumed by the first combination times a predetermined factor larger than one, and then selects a target combination that is the closest to the current operating combination among the second group of combinations.

8. The control system of claim 1, wherein the plurality of machines are air compressors, the consumable material is compressed air and the recipient system is a manufacturing facility.

9. A control system for operating a plurality of air compressors collectively supplying compressed air to a manufacturing facility, the control system comprising:

a database configured to store consumption history of the compressed air and future operating information of the manufacturing facility;

a pressure sensor configured to acquire a current air pressure from the manufacturing facility;

a controller configured to control operations of the plurality of air compressors and sample a current operating combination of the plurality of air compressors; and at least one computing device executing software instructions to:

calculate the manufacturing facility's future demand for the compressed air at a predetermined future time based at least in part on the stored consumption history and the future operating information, produce a final forecast based at least in part on combining the current air pressure and the future demand, determine a maximum number and a minimum number of the plurality of air compressors to be turned on to meet the final forecast, determine a target operating combination of the plurality of air compressors at the predetermined future time based on the final forecast and the current operating combination of the plurality of air compressors, and send at least one control signal carrying the target operating combination to the controller for operating the plurality of air compressors based on the target operating combination, wherein the controller is configured to operate the plurality of air compressors based on receiving the at least one control signal.

10. The control system of claim 9, further comprising:

at least one volume sensor configured to measure a volume of the compressed air supplied by each of the plurality of air compressors during a predetermined time period;

at least one power meter configured to measure an amount of power consumed by each of the plurality of air compressors during the predetermined time period; and the at least one computing device executing software instructions to calculate an energy efficiency rate (EER) of each of the plurality of air compressors by dividing the volume of the compressed air supplied by the air compressor by the amount of power consumed by the air compressor.

11. The control system of claim 9, wherein the stored consumption history comprises historic data of the compressed air supplied by the plurality of air compressors and an average consumption rate of the compressed air by the manufacturing facility.

12. The control system of claim 11, wherein the historic data of the compressed air supplied by the plurality of air compressors comprise operating information of each of the plurality of air compressors during a time period the historic data occur.

13. The control system of claim 9, wherein the at least one computing device executing software instructions converts a difference between the air pressure and a predetermined threshold to a volume of compressed air.

14. The control system of claim 9, wherein the at least one computing device executing software instructions determines a first group of combinations of the plurality of air compressors to be turned on within the maximum and the minimum number of the plurality of air compressors.

15. The control system of claim 14, wherein the at least one computing device executing software instructions selects a first combination that consumes the least power among the first group of combinations based on the EER of each of the plurality of machines, then selects a second group of combinations of the plurality of air compressors with each member of the combination consuming less power than is consumed by the first combination times a predetermined factor larger than one, and then selects a target combination that is the closest to the current operating combination among the second group of combinations.

16. A method for operating a plurality of air compressors collectively supplying compressed air to a manufacturing facility, the method comprising:

storing consumption history of the compressed air and future operating information of the manufacturing facility in a database;

acquiring, by a pressure sensor, a current air pressure from the manufacturing facility;

sampling, by a controller of the plurality of air compressors, a current operating combination of the plurality of air compressors;

calculating, by at least one computing device, the manufacturing facility's future demand for the compressed air at a predetermined future time based at least in part on the stored consumption history and the future operating information;

converting, by the at least one computing device, a difference between the current air pressure and a predetermined threshold to a first volume of compressed air;

generating, by the at least one computing device, a final forecast based at least in part on combining the first volume and the future demand;

determining, by the at least one computing device, a target operating combination of the plurality of air compressors at the predetermined future time based on the final forecast and the current operating combination of the plurality of air compressors; and sending, by the at least one computing device, at least one control signal carrying the target operating combination to the controller for operating the plurality of air compressors based on the target operating combination, wherein the controller is configured to operate the plurality of air compressors based on receiving the at least one control signal.

17. The method of claim 16, further comprising:

measuring, by at least one volume sensor, a volume of the compressed air supplied by each of the plurality of air compressors during a predetermined time period;

measuring, by at least one power meter, an amount of power consumed by each of the plurality of air compressors during the predetermined time period; and calculating, by the at least one computing device, an energy efficiency rate (EER) of each of the plurality of air compressors by dividing the volume of the compressed air supplied by the air compressor by the amount of power consumed by the air compressor.

18. The method of claim 16, wherein the stored consumption history comprises historic data of the compressed air supplied by the plurality of air compressors and an average consumption rate of the compressed air by the manufacturing facility.

19. The method of claim 18, wherein the historic data of the compressed air supplied by the plurality of air compressors comprise operating information of each of the plurality of air compressors during a time period the historic data occur.

20. The method of claim 16, wherein determining the target operating combination of the plurality of air compressors comprises determining a maximum number and a minimum number of the plurality of air compressors that meet the final forecast, determining a first group of combinations of the plurality of air compressors to be turned on within the maximum and the minimum number of the plurality of air compressors, selecting a first combination that consumes the least power among the first group of combinations, then selecting a second group of combinations of the plurality of air compressors with each member of the combination consuming less power than is consumed by the first combination times a predetermined factor larger than one, and then selecting a target combination that is the closest to the current operating combination among the second group of combinations.

* * * * *